US005929825A

United States Patent [19]

Niu et al.

[11] Patent Number: 5,929,825

[45] Date of Patent: Jul. 27, 1999

[54] FOLDED SPIRAL ANTENNA FOR A PORTABLE RADIO TRANSCEIVER AND METHOD OF FORMING SAME

[75] Inventors: Feng Niu, Weston; Wei-Yean Howng, Coral Springs; Jon Patrick Oliver, Plantation, all of Fla.

[73] Assignee: Motorola, Inc., Schaumburg, Ill.

[21] Appl. No.: 09/036,695

[22] Filed: Mar. 9, 1998

[51] Int. Cl.[6] ..... H01Q 1/36

[52] U.S. Cl. ..... 343/895; 343/866

[58] Field of Search ..... 343/895, 700 MS, 343/866, 867, 741, 742, 893, 846, 848; H01Q 1/36

[56] References Cited

U.S. PATENT DOCUMENTS 4,658,262 4/1987 DuHamel ..... 343/895

5,313,216 5/1994 Wang et al. ..... 343/700 MS 5,583,523 12/1996 Wallace, Jr. ..... 373/700 MS

*Primary Examiner*—Hoanganh Le

*Attorney, Agent, or Firm*—Frank M. Scutch, III.

[57] ABSTRACT

A spiral antenna (100) having a feed-point end and a termination end for use within a portable two-way radio housing includes a ground substrate (102) and a number of spiral elements (103, 105) having a number of segments that form two or more spiral shapes. A shorting stub (107) connects the planar elements at a termination end for effectively increasing the feed-point impedance of the spiral antenna (100). The spiral elements (103, 105) may be positioned in a planar arrangement (FIGS. 1 and 2) or may be stacked in separate planes (FIGS. 3 and 4) for forming a limited space antenna having a substantially 50 ohm feed-point end impedance at resonance.

36 Claims, 4 Drawing Sheets

FOLDED SPIRAL ANTENNA FOR A PORTABLE RADIO TRANSCEIVER AND METHOD OF FORMING SAME

TECHNICAL FIELD

This invention relates in general to antennas and more particularly to antennas occupying limited space.

BACKGROUND

Conventional antennas used on portable two-way radio equipment typically are operated as a whip or helix type antenna and are designed to resonate at one or more desired wavelength. Antennas of this type are generally designed to operate at a 50 ohm input impedance. As is well known, these types of antennas generally extend out from the radio housing which significantly increases the perceived size of the radio housing.

It should be recognized that at a given center frequency, a significant reduction in the height of the conventional antenna will greatly decrease the antenna input impedance from a 50 ohm nominal value. This mismatch ultimately will cause a higher reflected power to the radio's power amplifier and a loss of the radio's transmitter power efficiency. Although circuitry can be used to match a lower antenna impedance to a 50 ohm nominal value, this circuitry can be complex, introducing significant insertion loss while ultimately adding additional manufacturing time and expense.

Thus, the need exists for a space efficient antenna structure that can be easily used within a radio housing having a 50 ohms impedance at resonant frequency in view of its limited size.

DETAILED DESCRIPTION OF THE PREFERRED EMBODIMENT

Figure 1:
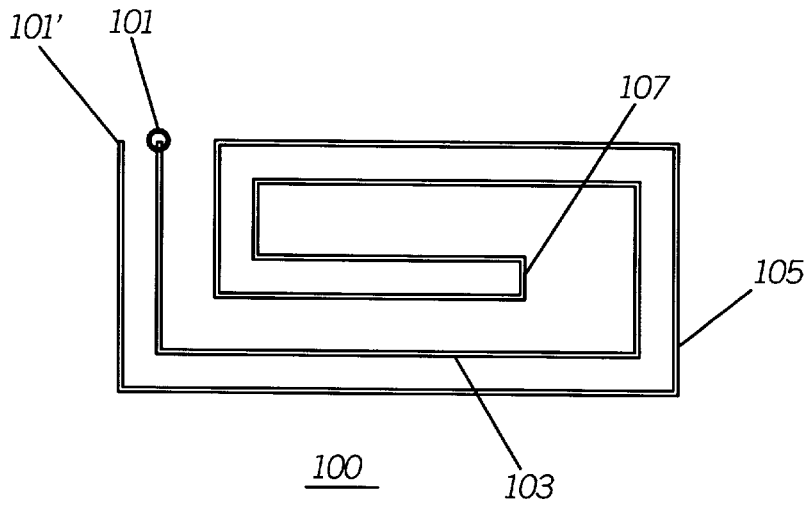
FIG. 1 is a top plan view of a single layer spiral antenna according to the preferred embodiment of the invention.
Figure 2:
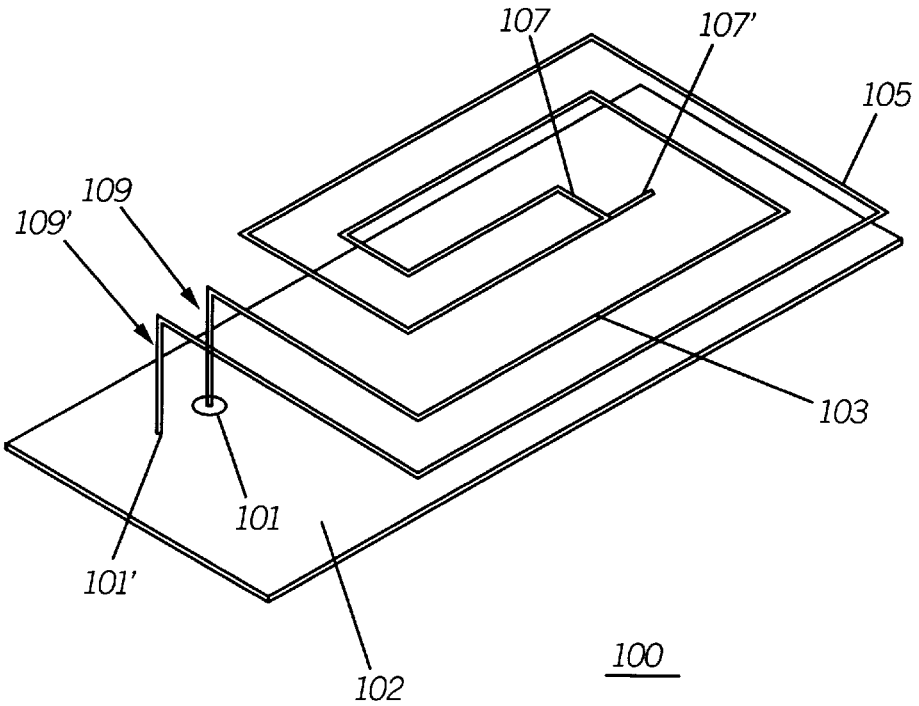
FIG. 2 is a top perspective view of that shown in FIG. 1 showing the additional use of a tuning stub.

Referring now to FIGS. 1 and 2, a planar folded spiral antenna 100 for a portable two-way radio transceiver includes a feed-point 101 and 101' positioned on one edge of a ground substrate 102. The antenna 100 includes a first spiral element 103 and a second spiral element 105 with each element comprised of a plurality of substantially linear segments. The segments are inter-connected in a substantially rectangular configuration successively reduced in size so as to form each respective spiral element. Although FIGS. 1 and 2 show the antenna 100 in a substantially rectangular shape, it will be evident to those skilled in the art the other shapes such as a substantially square or circular configuration can be also used. Furthermore, although FIG. 2 shows the antenna 100 in a homogeneous background above the ground substrate 102, it will be evident to those skilled in the art the other background configurations such as layered dielectric materials can be also used above the antenna and/or between the spiral structure and the ground substrate. Thus, the configuration shown in FIG. 1 could be positioned on one side of a single supporting substrate (such as a PC board) above the ground substrate in order to conserve space and provide an ease in manufacturing. Furthermore, it will be evident to those skilled in the art the ground substrate can also take other forms such as a two-way radio or a cellular phone.

The plurality of linear segments forming the first spiral element 103 and the plurality of segments forming the second spiral element 105 are positioned in a parallel relationship such that each of the respective segments are in the same plane. As best seen in FIG. 2, the folded spiral antenna is constructed as a uni-planar structure permitting the antenna to occupy a very limited space within a portable two-way radio housing. Conductive runners or traces are used as radiators and form both the first spiral element 103 and the second spiral element 105. Both the first spiral element 103 and the second spiral element 105 have a predetermined width and are separated by a predetermined distance.

At the terminating ends of both the first spiral element 103 and the second spiral element 105 a shorting strip or stub 107 is used to electrically interconnect both of the first spiral element 103 and the second spiral element 105 together. Since the second spiral element 105 is grounded at the feed-point end 101', this has the effect of increasing the feed-point impedance where it can be adjusted to substantially 50 ohms in order to properly match the required load impedance of a radio power amplifier (not shown). Although 50 ohms would be a typical value, the shorting stub 107 and the respective distance of the each spiral element 103, 105, above the ground substrate 102, permit this value to be easily adjusted.

The shorting stub 107 is generally one quarter of a wavelength away from the feeding point 101 to ensure that the current flow on the vertical sections 109 and 109' are in the same direction and thus maximize the antenna efficiency since the sections 109 and 109' are the main radiators of this antenna. Moving the shorting stub 107 further away from the feeding point 101 will add an effective capacitive load to the antenna impedance and thus increase the resonant frequency and the impedance at the resulting resonant frequency. On the other hand, moving the shorting stub 107 toward the feeding point 101 will add an effective inductive load to the antenna impedance and thus lower the resonant frequency and the impedance at the resulting resonant frequency.

The resonant frequency and the impedance of the antenna are increased by increasing the distance of spiral elements 103, 105 above the ground substrate because of the increased radiation of the antenna and the decreased capacitive coupling between the antenna and the ground substrate. The impedance of the antenna depends not only on the structure of the two spirals but also on the way the antenna is fed. Alternatively, the planar folded spiral antenna 100 may be fed by switching the feeding point 101 and grounding point 101' such that spiral element 105 is directly fed and spiral element 103 is grounded. This has the effect of lowering the antenna input impedance.

Figure 3:
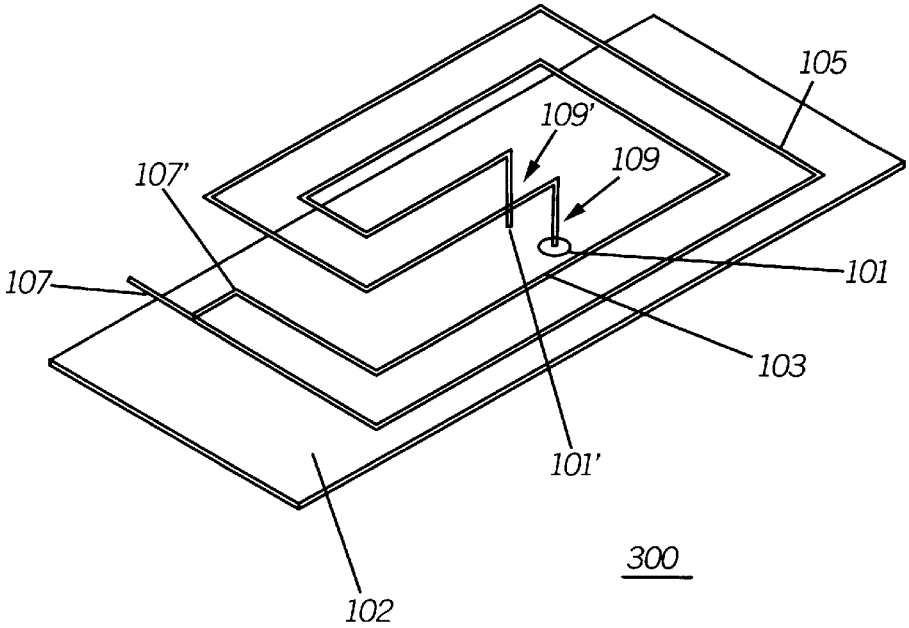
FIG. 3 is a top perspective view of an alternative embodiment to that shown in FIG. 2 wherein the single layer spiral antenna is fed at it's opposite end.

An alternative embodiment to FIG. 2 is shown in FIG. 3, where the feeding point 101 and grounding point 101' are moved to the inside of each spiral and the shorting stub 107 is also moved to the opposite end of each spiral radiator. FIGS. 2 and 3 differs from FIG. 1 in that a tuning stub 107' is attached to the shorting stub 107 and may be used for fine tuning the folded spiral antenna 100 to a specific resonant frequency. Increasing the length of the tuning stub 107' will lower the antenna resonant frequency and vice versa.

Figure 4:
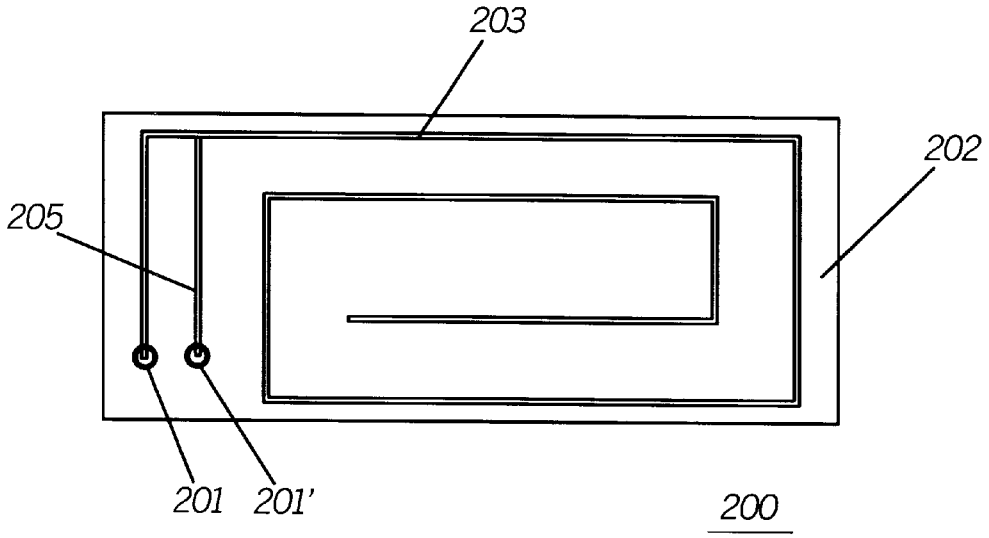
FIG. 4 is a top plan view of a two layer spiral antenna according to an alternative embodiment of the invention.
Figure 5:
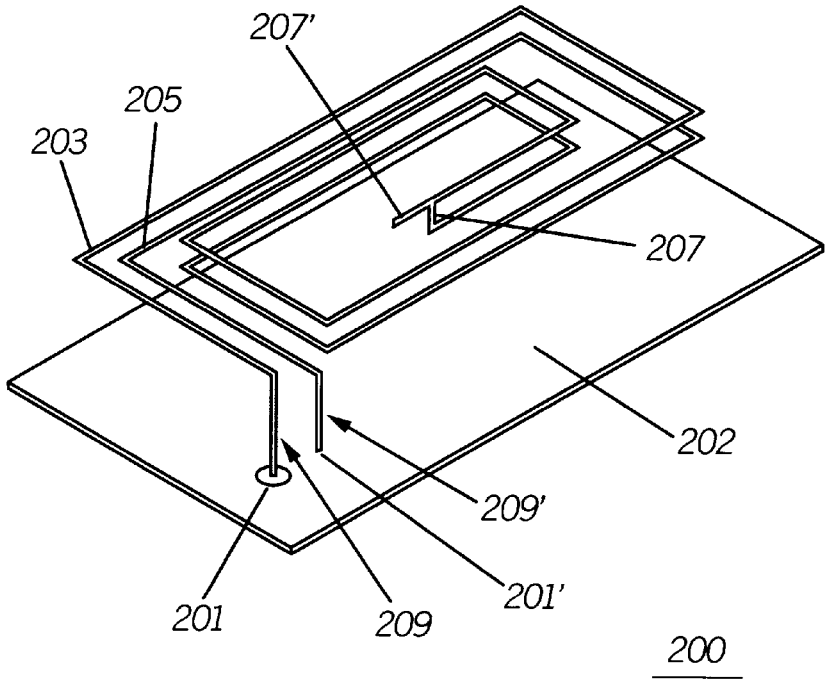
FIG. 5 is a top perspective view of that shown in FIG. 3 showing the additional use of a tuning stub.

In a second embodiment as shown in FIGS. 4 and 5, a multi-planar folded spiral antenna 200 includes a feed-point 201 and 201' positioned on one edge of a ground substrate 202. A first spiral element 203 and a second spiral element 205 each are comprised of a plurality of linear segments. The first spiral element 203 and the second spiral element 205 are positioned such that the second spiral element 205 is positioned in a plane beneath the first spiral element 203. Both the first spiral element 203 and second spiral element 205 are formed into a plurality of substantially rectangular spirals and are separated by a predetermined distance. Although FIG. 5 shows the antenna 200 in a homogeneous background above the ground substrate 202, it will be evident to those skilled in the art the other background configurations such as layered dielectric materials, such as a single or multi-layered supporting substrate, can be also used above the antenna, between the two layers of the spirals and between the spiral structure and the ground substrate. Thus, the two layers of spirals shown in FIG. 5 could be positioned on opposite sides of a single substrate (such as a PC board) above the ground substrate in order to conserve space and provide an ease in manufacturing.

At the terminating end of both the first spiral element 203 and the second spiral element 205, a shorting bar or stub 207 is used to electrically interconnect both elements. Since the second spiral element 205 is grounded to the ground substrate 202 at its feed-point end 201', this has the effect of increasing the feed-point impedance. Like the embodiment shown in FIGS. 1 and 2, this effectively raises the input impedance so it can be properly matched to a radio power amplifier output. Although 50 ohms would be a typical value, the shorting stub 207 and the height of the spirals, 209 and 209' above the ground substrate 202 and the distance between the spiral elements 203 and 205, permit this value to be easily adjusted.

The shorting stub 207 is generally a quarter of a wavelength away from the feeding point 201 to ensure that the current flow on the vertical sections 209 and 209' are in the same direction and thus maximize the antenna efficiency since the sections 209 and 209' are the primary radiators of this antenna. Moving the shorting stub 207 further away from the feeding point 201 will add an effective capacitive load to the antenna impedance and thus increase the resonant frequency and the impedance at the resulting resonant frequency. Conversely, moving the shorting stub 207 toward the feeding point 201 will add an effective inductive load to the antenna impedance and thus lower the resonant frequency and the impedance at the resulting resonant frequency.

The impedance of the antenna 200 is increased by increasing the distance of the spiral elements 203 and/or 205 above the ground substrate 202. The impedance of the antenna 200 depends not only on the structure of the two spiral elements 203, 205 but also on the manner that the antenna 200 is fed. An alternative way of feeding the antenna 200, in FIGS. 4 and 5, is to switch the feeding point 201 and grounding point 201' such that spiral element 205 is directly fed while spiral element 203 is grounded. However, this will result in a lower antenna input impedance. Additionally, FIG. 4 shows the use of a tuning stub 207' that permits the folded spiral antenna 200 to be fine tuned enabling it to operate at a specific resonate frequency.

Figure 6:
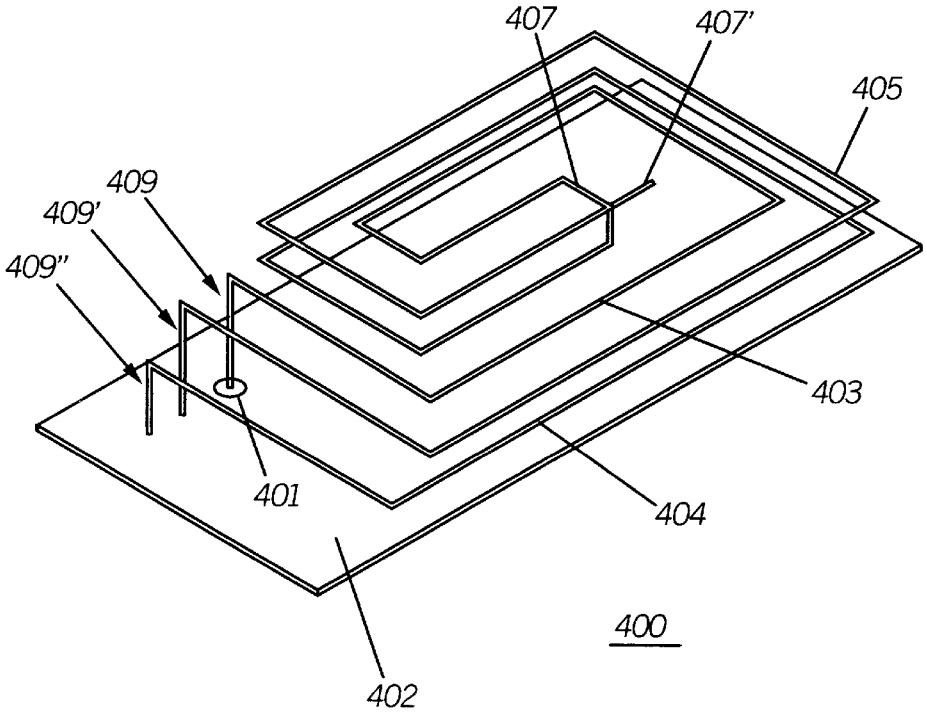
FIG. 6 is a top perspective view of an alternative embodiment to that shown in FIG. 5 wherein the two of the spiral radiators are in one plane and a third spiral radiator is in a second plane.
Figure 7:
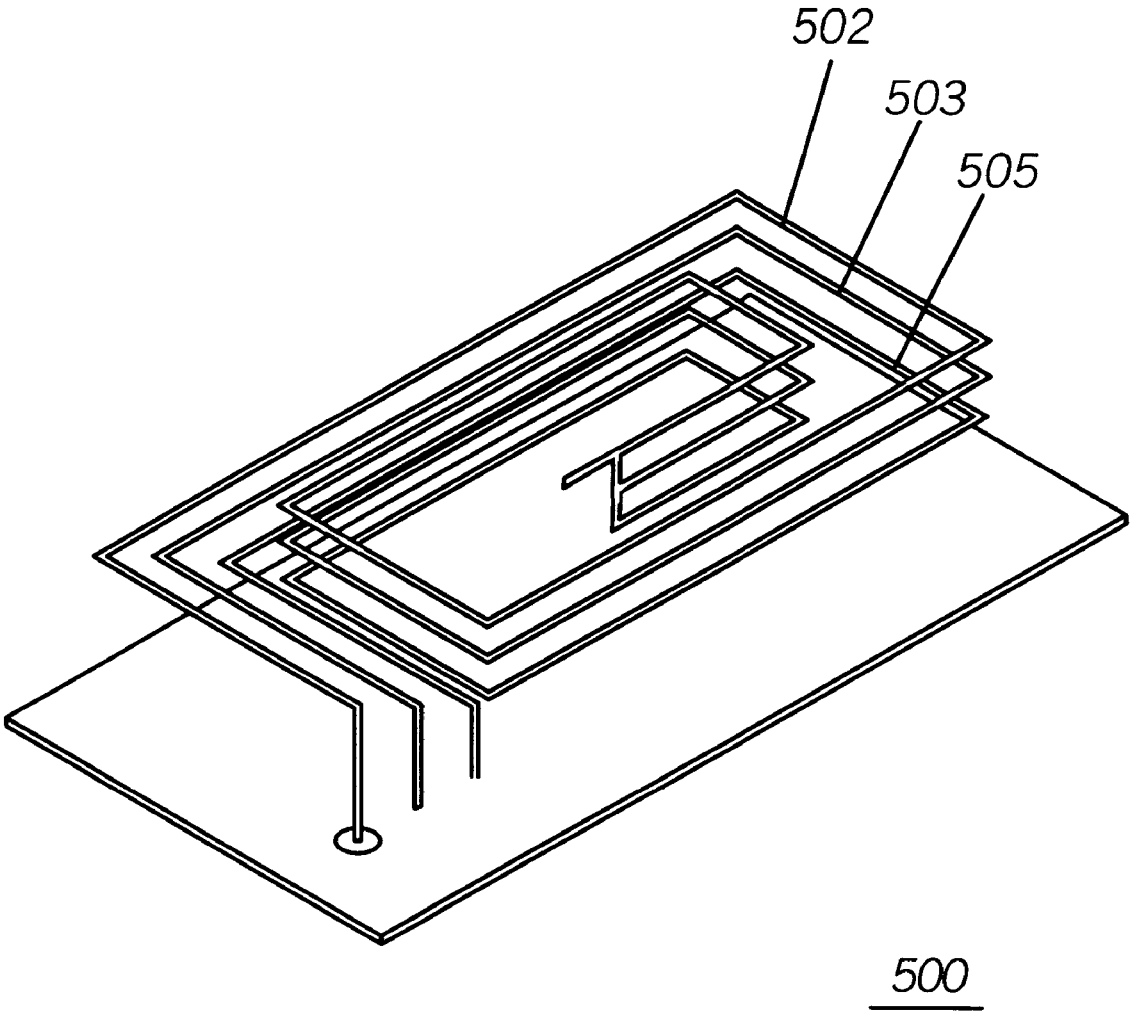
FIG. 7 is a top perspective view of a three layer spiral antenna according to an alternative embodiment of the invention.

In FIG. 6, a multi-planar spiral antenna 400 is yet another embodiment that is much like the embodiment in FIG. 5 however a first and second spiral element 403, 405 respectively are in one plane while a third spiral element 404 is positioned in a separate plane. The first spiral element 403 is directly fed using a vertical section 409 and the second and third spiral elements 405 and 404 are grounded at the ground substrate 402 using, respectively, vertical sections 409' and 409". As discussed above, a shorting stub 407 and a tuning stub 407' are used to tune the multi-planar spiral antenna 400 to a desired resonant frequency. Finally, FIG. 7 is another embodiment of a multi-planar spiral antenna 500 where each of the three spiral elements 502, 503 and 505 occupy different planes. The embodiments shown in FIGS. 6 and 7 offer additional advantages in that added antenna gain and efficiency can be achieved due to the additional spiral element acting as a radiator.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. A folded spiral antenna for a portable radio transceiver having a first end and a second end comprising:

a ground substrate;

a first planar spiral element having a plurality of first segments for forming a first spiral radiator;

a first vertical element for connecting the ground substrate with the first planar spiral element;

a second planar spiral element having a plurality of second segments positioned in a parallel relationship to those of the plurality of first segments and forming a second spiral radiator;

a second vertical element for connecting the ground substrate with the second planar spiral element;

a shorting stub for connecting the first planar spiral element with the second planar spiral element; and wherein the first planar spiral element and the second planar spiral element are positioned such that the second spiral radiator is positioned inside the first spiral radiator for providing a limited space antenna structure having a predetermined feed-point impedance at resonance.

2. A folded spiral antenna as in claim 1, further comprising a tuning stub for adjusting the antenna to a specific resonance frequency.

3. A folded spiral antenna as in claim 1, wherein the distance between the first planar spiral element and the second planar spiral element is varied to adjust the limited space antenna structure to a specific resonant frequency.

4. A folded spiral antenna as in claim 1, wherein the predetermined feed-point impedance is substantially 50 ohms.

5. A folded spiral antenna as in claim 1, wherein the distance of the first planar spiral element and the second planar spiral element above the ground substrate is varied for adjusting the limited space antenna structure to a specific resonant frequency and a desired impedance.

6. A folded spiral antenna as in claim 1, further wherein the shorting stub connects the first planar spiral element with the second planar spiral element at a second end of the antenna and the first vertical element and the second vertical element connect the first planar spiral element and the second planar spiral element at a first end with the ground substrate.

7. A folded spiral antenna as in claim 6, wherein the first planar spiral element is directly fed at the first end and the second planar spiral element is grounded to the ground substrate at the first end.

8. A folded spiral antenna as in claim 6, wherein the second planar spiral element is directly fed at the first end and the first planar spiral element is grounded to the ground substrate at the first end.

9. A folded spiral antenna as in claim 1, further wherein the shorting stub connects the first planar spiral element with the second planar spiral element at a first end of the antenna and the first vertical element and the second vertical element connects the first planar spiral element and the second planar spiral element at a second end with the ground substrate.

10. A folded spiral antenna as in claim 9, further wherein the first planar spiral element is directly fed at the second end and the second planar spiral element is grounded to the ground substrate at the second end.

11. A folded spiral antenna as in claim 9, further wherein the second planar spiral is directly fed at the second end and the first planar spiral is grounded to the ground substrate at the second end.

12. A folded spiral antenna as in claim 1, further comprising at least one supporting substrate above the ground substrate and wherein the first planar spiral element and the second planar spiral element are on a single side of the supporting substrate above the ground substrate.

13. A spiral antenna for use within a portable two-way radio housing having a feed-point end and a termination end comprising:

a ground substrate;

a first planar element having a plurality of first segments for forming a spiral shape;

a first vertical element for connecting the ground substrate with the first planar spiral element at the feed-point end;

a second planar element having a plurality of second segments positioned in a parallel relationship to the plurality of first segments;

a second vertical element for connecting the ground substrate with the second planar spiral element at the feed-point end;

a shorting post for connecting the first planar element with the second planar element; and wherein the first planar element and the second planar element are stacked in separate planes such that the first planar element is positioned above the second planar element for forming a limited space antenna having a substantially 50 ohm feed-point end impedance at resonance.

14. A spiral antenna as in claim 13, further comprising a tuning stub for adjusting the antenna to a specific resonant frequency.

15. A spiral antenna as in claim 13, wherein the first planar element or the second planar element can be fed depending a desired impedance value.

16. A spiral antenna as in claim 13, wherein the shorting post connects the first planar element with the second planar element at the feed-point end of the antenna.

17. A spiral antenna as in claim 13, wherein the first vertical element and the second vertical element connect the first planar spiral element and the second planar spiral element at the termination end with the ground substrate.

18. A spiral antenna as in claim 13, further comprising at least one supporting substrate above the ground substrate and wherein the first planar element is positioned on a first side and the second planar element is positioned on an opposite side of the supporting substrate positioned above the ground substrate.

19. A spiral antenna as in claim 13, further comprising at least one multi-layer substrate above the ground substrate and wherein the first planar element is positioned on one layer and the second planar element is positioned on a different layer of a multi-layer substrate above the ground substrate.

20. A spiral antenna having a feed-point end and a termination end for use within a portable two-way radio housing comprising:

a ground substrate;

a plurality of planar elements having a plurality of segments for forming a plurality of spiral radiators;

a plurality of vertical elements for connecting the ground substrate with the plurality of planar elements at the antenna feed-point end;

a shorting post for connecting the plurality of planar elements; and wherein the plurality of spiral radiators are stacked in separate planes such that each respective planar element of the plurality of planar elements is positioned above another respective planar element for forming a limited space antenna having a substantially 50 ohm feed-point end impedance at resonance.

21. A spiral antenna as in claim 20, wherein at least one of the plurality of spiral radiators of the antenna are fed at the feed-point end and the remainder of the plurality of spiral radiators are grounded at the feed-point end.

22. A spiral antenna as in claim 21, further wherein the shorting post connects the plurality of spiral radiators at the termination end.

23. A spiral antenna as in claim 20, further wherein the plurality of vertical elements connect the ground substrate with the plurality of spiral radiators at the antenna termination end and at least one of the plurality of spiral radiators are fed at the termination end while the remainder of the plurality of spiral radiators are grounded at the termination end.

24. A spiral antenna as in claim 23, further wherein the shorting post connects the plurality of spiral radiators at the feed-point end.

25. A spiral antenna as in claim 20, wherein the distance between the plurality of spiral radiators is varied in order to adjust the feed-point impedance value.

26. A spiral antenna as in claim 20, wherein the distance of the plurality of spiral resonators from the ground substrate is varied in order to adjust the feed-point impedance value.

27. A spiral antenna as in claim 20, further comprising at least one supporting substrate above the ground substrate and wherein respective ones of the plurality of elements are positioned on a first and a second side of the at least one supporting substrate above the ground substrate.

28. A spiral antenna as in claim 20, further comprising at least one multi-layer substrate above the ground substrate and wherein respective ones of the plurality of elements are positioned on different layers of the at least one multi-layer supporting substrate above the ground substrate.

29. A method of forming a spiral antenna with increased input impedance for use within a two- way radio housing comprising the steps of:

connecting a plurality of antenna segments into a plurality spiral radiators;

connecting at least one of the plurality of spiral radiators at a feed-point end to a ground substrate using at least one conductive vertical element and grounding the remainder of spiral radiators;

shorting the plurality spiral radiators at a terminating end with a conductive stub; and positioning the plurality of spiral radiators above the ground substrate such that each respective one of the plurality of antenna segments is positioned outside another one of the plurality of antenna segments in a single plane and further wherein each respective one of the plurality of spiral radiators is separated by a predetermined distance from the adjacent spiral radiator for creating a limited space antenna having a substantially 50 ohm feed-point impedance at resonance.

30. A method of forming a spiral antenna as in claim 29, further including the step of:

tuning the spiral antenna to a resonant frequency by varying the distance of the plurality of antenna segments above the ground substrate.

31. A method of forming a spiral antenna as in claim 29, further comprising the step of:

attaching a tuning stub to a terminating end of the second spiral radiator for fine tuning the spiral antenna to a resonant frequency.

32. A method of forming a spiral antenna as in claim 29, wherein the plurality of spiral radiators are separated by at least one supporting substrate above the ground substrate.

33. A method of forming a spiral antenna as in claim 32, wherein the at least one supporting substrate is air.

34. A method of forming a spiral antenna as in claim 32, further including the step of:

positioning respective ones of the plurality of spiral radiators on opposite sides of the at least one supporting substrate above the ground substrate.

35. A method of forming a spiral antenna as in claim 32, wherein that at least one supporting substrate is a multi-layer supporting substrate.

36. A method of forming a spiral antenna as in claim 35, further including the step of positioning respective ones of the plurality of spiral radiators on different layers of the at least one multi-layer supporting substrate above the ground substrate.

* * * * *